US009284510B2

(12) United States Patent
Massaro, Jr.

(10) Patent No.: US 9,284,510 B2
(45) Date of Patent: Mar. 15, 2016

(54) LUBRICANT COATING FOR LASER PRINTER WIPER BLADES

(71) Applicant: FLO-TECH, LLC, Middletown, CT (US)

(72) Inventor: Peter Vincent Massaro, Jr., West Haven, CT (US)

(73) Assignee: FLO-TECH, LLC, Middletown, CT (US)

( * ) Notice: Subject to any disclaimer, the term of this patent is extended or adjusted under 35 U.S.C. 154(b) by 163 days.

(21) Appl. No.: 13/932,825

(22) Filed: Jul. 1, 2013

(65) Prior Publication Data

US 2014/0051613 A1 Feb. 20, 2014

Related U.S. Application Data

(63) Continuation of application No. 13/584,947, filed on Aug. 14, 2012, now abandoned.

(60) Provisional application No. 61/817,621, filed on Apr. 30, 2013.

(51) Int. Cl.

*C10M 111/04* (2006.01)
*C10M 161/00* (2006.01)
*C10M 173/02* (2006.01)

(52) U.S. Cl.

CPC ..... *C10M 161/00* (2013.01); *C10M 173/02* (2013.01); *C10M 2201/061* (2013.01); *C10M 2207/02* (2013.01); *C10M 2209/084* (2013.01); *C10M 2213/02* (2013.01); *C10M 2217/045* (2013.01); *C10M 2229/02* (2013.01); *C10N 2230/06* (2013.01); *C10N 2240/06* (2013.01)

(58) Field of Classification Search

CPC ..... C10M 2201/061; C10M 2201/00; C10M 2213/062; C10M 2209/084
USPC ..... 508/155
See application file for complete search history.

(56) References Cited

U.S. PATENT DOCUMENTS

| | | | | |
|---|---|---|---|---|
| 2005/0137355 | A1 * | 6/2005 | Buckanin et al. | 525/374 |
| 2007/0003588 | A1 * | 1/2007 | Chinn et al. | 424/423 |
| 2009/0047475 | A1 * | 2/2009 | Jeon | 428/145 |
| 2010/0325830 | A1 * | 12/2010 | Duval et al. | 15/250.48 |

OTHER PUBLICATIONS

Kusumoto Chemicals, Ltd., Disparlon AQ-7120, Aug. 2011, Distributed by King Industries.*

* cited by examiner

*Primary Examiner* — Vishal Vasisth
(74) *Attorney, Agent, or Firm* — Bachman & LaPointe, P.C.

(57) ABSTRACT

A lubricant coating for laser printer wiper blades is a solution applied to a laser printer wiper blade before install that reduces friction between the wiper blade and the photoconductor drum of a laser printer in order to reduce wear, prevent damage and increase life of the wiper blade and photoconductor drum. A leveling and wetting agent ensures uniform application and reduces coating defects. An anti-wear agent reduces friction and acts as an electrical insulator. A friction reducing agent also reduces friction and acts as an electrical insulator. An evaporation promoting agent aids in evaporation of unnecessary material after application to a wiper blade. A coating enhancing agent increases the hardness of the coating and provides assistance in adherence of the solution to the wiper blade. Deionized water acts as a carrier. The solution is mixed in a high shear mixture.

2 Claims, 4 Drawing Sheets

LUBRICANT COATING FOR LASER PRINTER WIPER BLADES

This application claims benefit of 61/817,621, filed Apr. 30, 2013 and is a CON of Ser. No. 13/584,947, filed Aug. 14, 2012, which is now abandoned.

The current application claims a priority to the U.S. Non-provisional patent application Ser. No. 13/584,947 filed on Aug. 14, 2012 and to the U.S. Provisional Patent application Ser. No. 61/817,621 filed on Apr. 30, 2013.

FIELD OF THE INVENTION

The present invention relates generally to lubricants. More particularly, the present invention is a formula for laser printer wiper blades that is designed to reduce friction between a wiper blade and a photoconductor surface in a laser printer.

BACKGROUND OF THE INVENTION

Modern xerographic laser printers primarily utilize static electricity as a mechanism of operation. Toner is stored in powder form within toner cartridges for use when forming images on paper. Perhaps the most important component of a laser printer is the photoconductor. The photoconductor generates a positive electrical charge when exposed to light during a print cycle. An electrostatic image is formed on the surface of the photoconductor by negatively discharging corresponding portions of the photoconductor. A typical photoconductor comprises a multilayered aluminum tube and may be incorporated into a toner cartridge or remain an independent component. During a print cycle, positively charged toner powder is electrostatically drawn from the toner hopper and is transferred to the negatively discharged portions of the photoconductor. The toner powder clings to the photoconductor and forms the electrostatic image on the surface of the photoconductor. Conversely, the toner powder is magnetically repelled from the remaining positively charged portions of the photoconductor. A transfer roller applies a positive charge to the back of the media. The positive charge attracts the toner image from the photoconductor and transfer the image from the photoconductor to the media. The transferred toner powder on the media passes through a fuser, where heat and pressure are applied to permanently bond the toner to the media.

Following the fusing process, a primary charge roller is charged with an alternating current (AC) electrical signal, which functions to remove any residual static charge on the drum left from the previous image. Remaining toners on the photoconductor are removed by a wiper blade and deposited into the toner cartridge waste cavity. As the wiper blade is constantly in contact with the photoconductor, friction can potentially cause damage to the surface of the photoconductor, directly affecting image quality. More serious issues such as blade flipping can occur, causing the laser printer motor drive to fail or causing the wiper blade to drag toner across the surface of the photoconductor, leaving a layer of toner on the sheet of paper. In the worst case scenario, the wiper blade may crack or snap, breaking contact with the surface of the photoconductor and causing the removed toner in the cartridge waste cavity to leak. A conventional solution for reducing friction is repurposing toner as a lubricant on the photoconductor although this directly affects the image quality of a laser printer. An alternate solution involves the application of a solution such as zinc stearate to the photoconductor prior to assembly of the toner cartridge. However, the solution is applied manually and can be rather tedious and unrepeatable.

The present invention seeks to address the previously discussed issues and provide a practical, convenient, and repeatable solution.

The present invention is a lubricant that is applied to the wiper blade of a photoconductor in order to reduce friction between the wiper blade and the photoconductor surface. The present invention seeks to reduce the friction between the wiper blade and the photoconductor surface while maintaining contact between the two components. This prevents wear and damage to the wiper blade and the photoconductor. The present invention accomplishes this without compromising print quality. The lubricant is applied to the wiper blade prior to installation by any liquid coating application technique including, but not limited to, dipping, spraying, flow coating, and applicator brushing. Following application, the blade and coating are heated in an air circulation oven for a specified period of time.

DETAIL DESCRIPTIONS OF THE INVENTION

All illustrations of the drawings are for the purpose of describing selected versions of the present invention and are not intended to limit the scope of the present invention.

Figure 2:
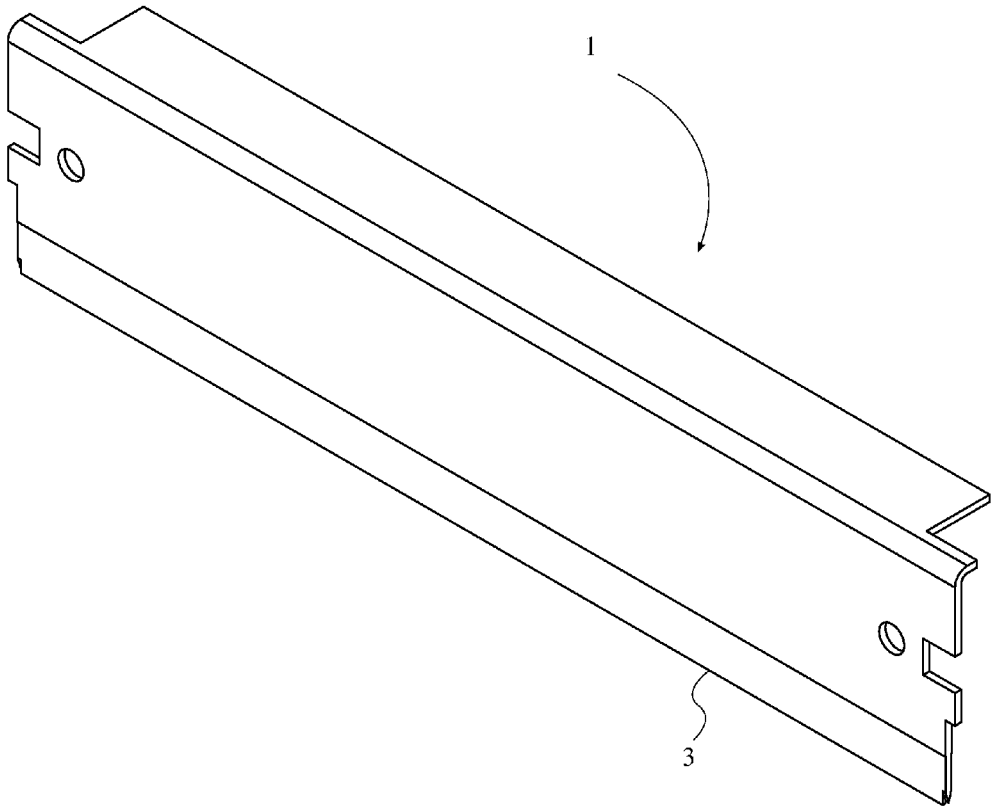
FIG. 2 is an isometric view of an example wiper blade.
Figure 3:
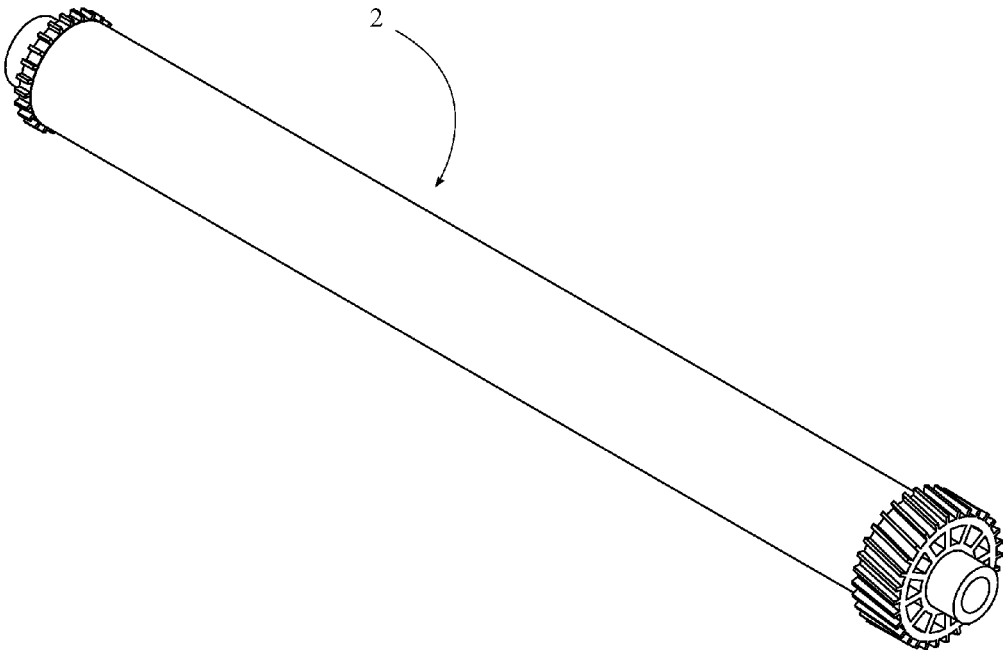
FIG. 3 is an isometric view of an example organic photo conductor drum.
Figure 4:
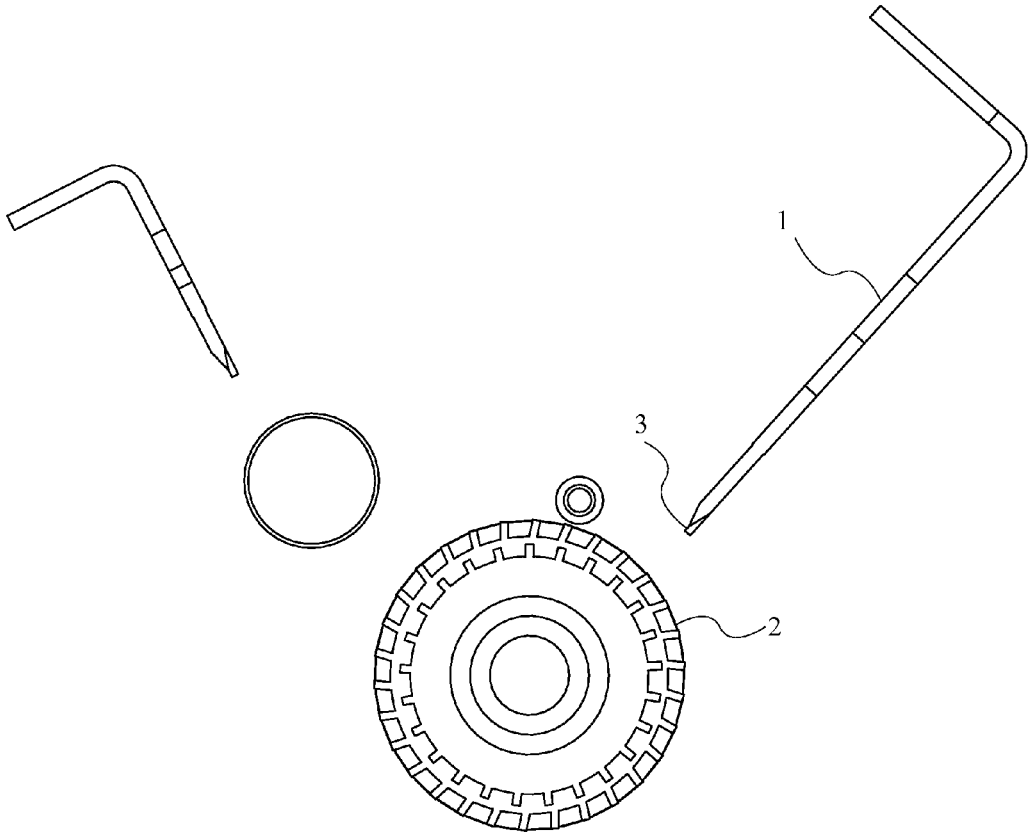
FIG. 4 is a side exploded view of a wiper blade, photoconductor, developer roller, conditioning roller, and doctor blade, showing an example arrangement.

The present invention is a formula for lubricating wiper blade is used in laser printers. Referring to FIGS. 2-4, in a laser printer a wiper blade 1 removes toner residue from a rotating organic photo conductor (OPC) drum into a waste cavity. The wiper blade 1 makes contact with the surface of the OPC drum 2 at approximately a 90 degree angle with a high degree of precision in order to effectively remove the toner residue. It is desirable to reduce friction between the wiper blade 1 and the OPC drum 2 in order to prevent problems such as damage to the OPC drum 2, toner issues, damage to the wiper blade 1 or flippage of the wiper blade 1. The present invention is a formula for a lubricant that may be applied to the wiper blade 1 just once before assembly, which reduces friction between the wiper blade 1 and the OPC drum 2 for the life of the wiper blade 1, and which does not affect print quality.

Figure 1:
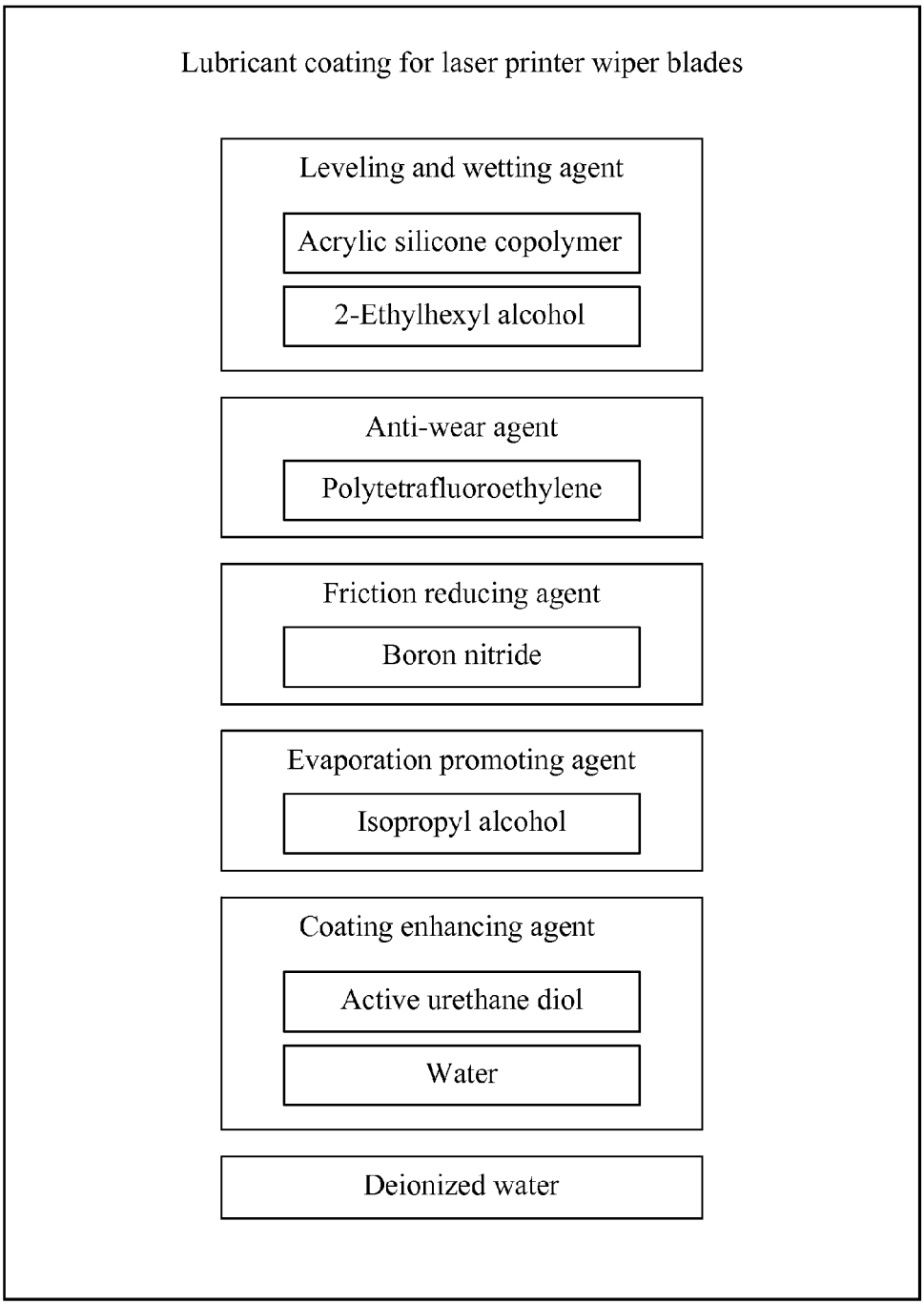
FIG. 1 is a block diagram of the components of the present invention.

Referring to FIG. 1, the preferred embodiment of the present invention comprises a leveling and wetting agent, an anti-wear agent, a friction reducing agent, an evaporation promoting agent, a coating enhancing agent, and deionized water.

In the preferred embodiment of the present invention, the leveling and wetting agent comprises acrylic-silicone copolymer and a solvent. More specifically, the leveling and wetting agent comprises the acrylic silicone copolymer at 30 percent weight and the solvent comprises 2-Ethylhexyl alcohol. Useful commercially available leveling and wetting agents include those manufactured under the Disparlon® brand by Kasumoto Chemicals, Ltd. of Tokyo, Japan. In the preferred embodiment of the present invention, the leveling and wetting agent is Disparlon® AQ-7120. In alternate embodiments, other leveling and wetting agents with similar properties to Disparlon® AQ-7120 may be used. In the context of the present invention, the leveling and wetting agent ensures that the present invention is applied uniformly on the wiper blade 1 by reducing surface tension of a wet coat in order to promote uniform application and reduce coating defects. In the preferred embodiment, the wetting agent is present at about 10 percent weight. In alternate embodiments, the leveling and wetting agent is present at a range between 5-15 percent weight.

In the preferred embodiment of the present invention, the anti-wear agent is polytetrafluoroethylene (PTFE), Chemical Abstracts Service (CAS) registry number 9002-84-0. PTFE has an extremely low coefficient of friction against solid surfaces, which aids in reducing friction between the wiper blade 1 and the OPC drum 2. As a result, lifetime wear and probability of damage to the wiper blade 1 and the OPC drum 2 are reduced. Additionally, PTFE has dielectric properties, as serves as an insulator against electric current passing through the wiper blade 1. This is useful because the wiper blade 1 operates in an electrostatic environment due to the nature of laser printing. In the preferred embodiment, the anti-wear agent is present at about 8 percent weight. In alternate embodiments, the anti-wear agent is present at a range between 5-10 percent weight.

In the preferred embodiment of the present invention, the friction reducing agent is boron nitride (BN), CAS registry number 10043-11-5. Preferably, the friction reducing agent is specifically hexagonal boron nitride (HBN). In alternate embodiments, the friction reducing agent may be another compound with similar properties to BN. The BN provides the primary lubricating properties of the present invention to reduce friction between the wiper blade 1 and the OPC drum 2, allowing the wiper blade 1 to slide smoothly along the surface of the OPC drum 2 without damaging the wiper blade 1 or the OPC drum 2. As with PTFE, the BN also displays dielectric properties which lends to insulating the wiper blade 1 from electrical current. In the preferred embodiment, the friction reducing agent is present at about 10 percent weight. In alternate embodiments, the friction reducing agent is present at a range between 7-30 percent weight.

The evaporation promoting agent facilitates evaporation of non-essential components of the present invention, particularly the deionized water, after application to a wiper blade 1. In the preferred embodiment of the present invention, the evaporation promoting agent is isopropyl alcohol, CAS registry number 67-63-0. In alternate embodiments, the evaporation promoting agent may be other compounds with similar properties to isopropyl alcohol that facilitate evaporation of non-essential components of the present invention after application to a wiper blade 1. In the preferred embodiment, the evaporation promoting agent is present at about 5 percent weight. In alternate embodiments, the evaporation promoting agent is present at a range between 0-6 percent weight.

The coating enhancing agent augments the present invention by increasing hardness of the coating once dry, in addition to aiding in the present invention adhering to the wiper blade 1 after application. In the preferred embodiment of the present invention, the coating enhancing agent is an aqueous solution of an aliphatic, low molecular weight urethane diol oligomer. Useful commercially available coating enhancing agents include those manufactured under the K-Flex® brand by King Industries of Norwalk, Conn. In the preferred embodiment of the present invention, the coating enhancing agent is K-Flex® UD-350W. In alternate embodiments, the coating enhancing agent may be another solution with similar properties to K-Flex® UD-350W, such as, but not limited to, K-Flex® UD-320W. The coating enhancing agent (as K-Flex® UD-350W) comprises 88 percent active urethane diol and 12 percent water. In the preferred embodiment, the coating enhancing agent is present at 5 percent weight. In alternate embodiments, the coating enhancing agent is present at a range between 2-15 percent.

In the context of the present invention, the deionized water acts as a carrier for the leveling and wetting agent, the anti wear agent, the friction reducing agent, the evaporation promoting agent, and the coating enhancing agent. Deionized water is water ($H_2O$) that has had mineral ions removed, such as cations like sodium, calcium, iron, and copper, and anions such as chloride and sulfate. The present invention requires the use of water that has been deionized to act as a carrier in order to prevent any other components from bonding with mineral ions, resulting in unexpected or undesirable changes to the present invention. Additionally, contaminants present within water may leave behind residue on the surface of the wiper blade 1 following evaporation of the water. In the preferred embodiment of the present invention, the deionized water is present at 62 percent weight. In alternate embodiments, the deionized water is present at a range between 50-80 percent weight.

The individual ingredients of the present invention are thoroughly mixed by means of a high shear mixer. A high shear mixer generally utilizes rotors and stators to generate shear forces. As a result, the high shear mixer is able to incorporate all ingredients into a main continuous liquid mixture. The mixing process is continued until all of the ingredients have been fully dispersed within the deionized water to produce a thoroughly mixed lubricant.

The thoroughly mixed lubricant may be applied to a wiper blade 1 by any liquid coating application technique including, but not limited to, dipping, spraying, flow coating, and applicator brushing. The lubricant coats all portions of the wiper blade 1 that come into contact with the OPC drum 2, particularly a top leading edge 3 of the wiper blade 1. After the lubricant has been applied, the wiper blade 1 is heated in an air circulation oven for a specified amount of time. After the lubricant coating is dried, the wiper blade 1 may be installed. During initial installation of a toner cartridge, a printer cycles through a preset rotation. Before an initial print job is sent to the printer, the toner cartridge runs dry with no toner on the drum or wiper blade. This causes a high amount of torque and stress on the drum and wiper blade. The formula of the present invention reduces the dry startup torque. During a print cycle, the wiper blade 1 maintains constant contact with the OPC drum 2 as the OPC drum 2 rotates. Following the initial discharge of toner on the OPC drum 2 surface, the wiper blade 1 strips away the remaining toner on the OPC drum 2 surface. The residual toner is removed gradually as the OPC drum 2 rotates and is deposited into the waste cavity of the toner cartridge. All portions of the wiper blade 1 that come into contact with the OPC drum 2 are sufficiently lubricated. As a result, friction between the wiper blade 1 and the OPC drum 2 is reduced. The reduced friction lowers the likelihood of serious issues occurring such as blade flipping, cracking, or snapping. Additionally, by reducing the overall mechanical stress experienced by the wiper blade 1 and the OPC drum 2, the operational lifespan of each individual component is increased. The present invention does not require reapplication and is intended to remain on the wiper blade 1 for the duration of the lifespan of the wiper blade 1.

Although the invention has been explained in relation to its preferred embodiment, it is to be understood that many other possible modifications and variations can be made without departing from the spirit and scope of the invention as hereinafter claimed.

What is claimed is:

1. A method for reducing friction between a wiper blade and a photoconductor drum in a laser printer, said method comprising the steps of:

preparing a lubricant coating containing 5-15 wt % of a level and wetting agent, 5-10 wt % of an anti-wear agent, 7-30 wt % of a friction reducing agent, up to 6 wt % of an evaporating promoting agent, 2-15 wt % of a coating enhancing agent; and 50-80 wt % of deionized water as a carrier;

applying said lubricant coating to said wiper blade so that said lubricant coating coats all portions of said wiper blade that come into contact with the photoconductor drum; and heating said lubricant coating and said wiper blade in an oven.

2. The method of claim 1, further comprising installing the wiper blade after said lubricant coating has dried.

* * * * *